US005601410A

United States Patent [19]

Quinlan

[11] Patent Number: 5,601,410

[45] Date of Patent: Feb. 11, 1997

[54] FAN HAVING BLADES WITH SOUND REDUCING MATERIAL ATTACHED

[75] Inventor: Daniel A. Quinlan, Warren, N.J.

[73] Assignee: Lucent Technologies Inc., Murray Hill, N.J.

[21] Appl. No.: 522,485

[22] Filed: Aug. 31, 1995

[51] Int. Cl.[6] ..... F04D 29/38

[52] U.S. Cl. ..... 416/241 A; 416/241 R; 415/119

[58] Field of Search ..... 415/119; 416/241 R, 416/241 A, 223 R

[56] References Cited

U.S. PATENT DOCUMENTS

| | | | |
|---|---|---|---|
| 3,275,082 | 9/1966 | Stark | 416/241 R |

FOREIGN PATENT DOCUMENTS

| | | | |
|---|---|---|---|
| 0196337 | 10/1986 | European Pat. Off. | 416/241 A |
| 0036606 | 3/1979 | Japan | 415/119 |
| 0082299 | 4/1987 | Japan | 416/241 R |
| 1237399 | 9/1989 | Japan | 416/241 A |
| 5126093 | 5/1993 | Japan | 415/119 |
| 6101696 | 4/1994 | Japan | 415/119 |
| 2015419 | 6/1994 | Russian Federation | 416/241 R |
| 0628323 | 8/1978 | U.S.S.R. | 416/241 R |
| 1761979 | 9/1992 | U.S.S.R. | 415/119 |

OTHER PUBLICATIONS

W. K. Blake, "Mechanics of Flow–Induced Sound And Vibration," Complex Flow–Structure Interactions Academic Press, Inc., vol. II, 1986, pp. 782–806.

T. F. Brooks et al., "Trailing Edge Noise Prediction From Measure Surface Pressures," Journal of Sound and Vibration, 1981, 78(1), pp. 69–117.

D–I.F. Kameler et al, "Experimental Investigation Of Tip Clearance Noise In axial Flow Machines," Proc. DGLR/ACAA–Aeroacoustics Conf., pp. 92–02–40, 250–259.

J. E. Ffowcs Williams et al, "Aerodynamic Sound Generation By Turbulent Flow In The Vicinity Of A Scattering half Plane," J. Fluid Mech., 1970, vol. 10, part 4, pp. 657–670.

R. K. Amiet, "Noise Due To Turbulent Flow Past A Trailing Edge," Journal of Sound and Vibration, 1976, 47(3), pp. 387–393.

R. E. Longhouse, "Control Of Tip–Vortex Noise Of Axial Flow Fans By Rotating Shrouds," Journal of Sound and Vibration, 1978, 58(2), pp. 201–214.

*Primary Examiner*—F. Daniel Lopez
*Assistant Examiner*—Mark Sgantzos
*Attorney, Agent, or Firm*—Kenneth M. Brown

[57] ABSTRACT

An air moving device such as an axial cooling fan comprises a rotatable shaft assembly and a plurality of fan blades coupled to the rotatable shaft assembly, each of the fan blades having a trailing edge when the rotatable shaft assembly is rotated in a given direction. In accordance with one illustrative embodiment of the invention, at least one of the fan blades has a sound reducing material attached thereto alongside the trailing edge thereof. The sound reducing material reduces aeroacoustic noise by reducing the aerodynamic effect that occurs when turbulence produced by the pressure differential between the two sides of one blade comes into contact either with the trailing edge of the given blade which created it, or, more significantly, with the following blade, at or near that blade's trailing edge. In various embodiments the sound reducing material may comprise felt, loops from a hook-and-loop-type fastener such as that sold under the VELCRO trademark, or a small piece of fiberglass, cotton or wool batting. In one illustrative embodiment, the sound reducing material is advantageously attached to the fan blade on the high pressure side thereof.

24 Claims, 1 Drawing Sheet

FAN HAVING BLADES WITH SOUND REDUCING MATERIAL ATTACHED

CROSS-REFERENCE TO RELATED APPLICATION

The subject matter of this application is related to the U.S. patent application of P. Bent, R. Kubli and D. Quinlan entitled "Fan Having Blades with Flanges," Ser. No. 08/522,013, filed on even date herewith and assigned to the assignee of the present invention. "Fan Having Blades with Flanges" is hereby incorporated by reference as if fully set forth herein.

FIELD OF THE INVENTION

The present invention relates generally to the field of air moving devices such as cooling fans and more particularly to techniques for reducing the aeroacoustic noise generated by such devices.

BACKGROUND OF THE INVENTION

Cooling fans have been used for many years in a wide variety of electronic systems including, for example, audio and video home electronics and both home-based and office-based computer systems. These fans are typically needed to prevent overheating of the electronic components contained in such systems. However, a long recognized annoyance which results from the use of cooling fans is the often substantial amount of aeroacoustic noise which these fans generate. More often than not, this noise is considered an unavoidable consequence of fan-based cooling techniques, and users of electronic systems have come to accept the attendant noise associated therewith.

SUMMARY OF THE INVENTION

It has been recognized that the air flow around the tips of fan blades can be a primary source of the aeroacoustic noise generated by cooling fans. In particular, a pressure differential is typically created between the two sides of the blades (since these blades are usually angled with respect to their plane of motion)—a high pressure side which is moving forward into the otherwise stationary air between successive blades, and a low pressure side which is moving away from the otherwise stationary air between successive blades. This pressure differential causes air flow through the gap between the blade tip and the fan housing from the high pressure side to the low pressure side. After passing through the gap, the flow forms a "tip" vortex—that is, the flow "rolls up" along the blade tip. This vortex lifts off from the blade that generated it and convects into the passage between the blades, thereby generating turbulent energy.

As a result of the above, it has further been recognized that one source of aeroacoustic noise in these cooling fans is created when the above-described turbulence comes into contact either with the trailing edge of the given blade which created it (on the low pressure side of the blade), or, more significantly, with the following blade, at or near that blade's trailing edge (on the high pressure side of the blade). In order to reduce these and similar sources of aeroacoustic noise and in accordance with the present invention, a sound reducing material is attached to the fan blades alongside the trailing edges thereof. In this manner, the impacting aerodynamic energy resulting from the turbulence is at least partially absorbed, thereby reducing the resulting aeroacoustic noise generated by the fan.

DETAILED DESCRIPTION

Figure 1A:
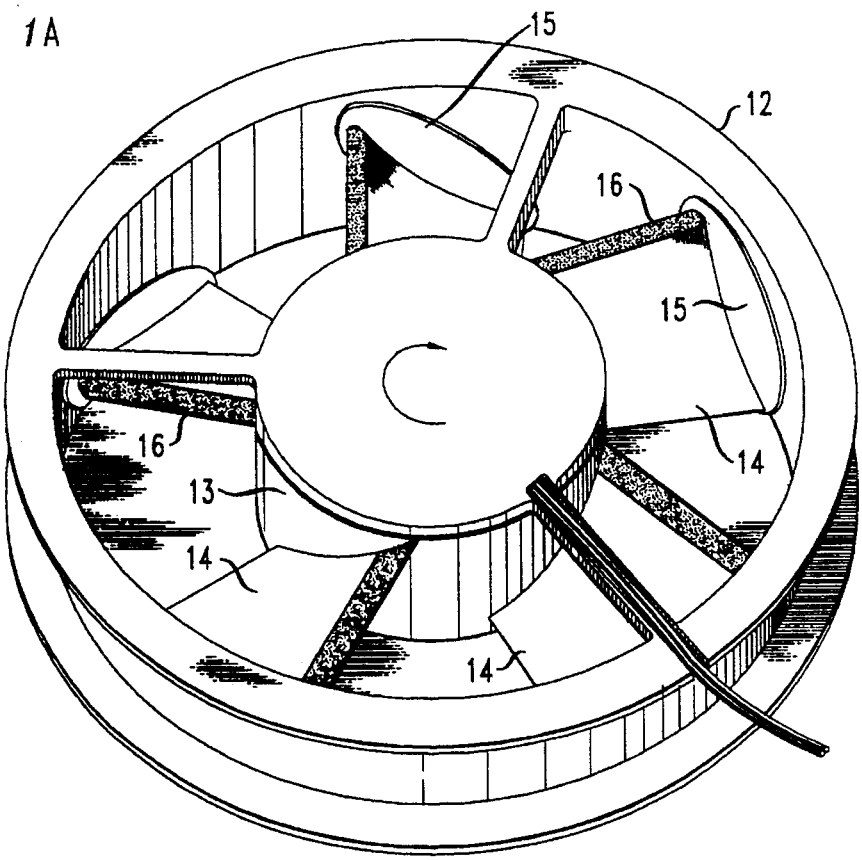
FIG. 1 shows an axial cooling fan having sound reducing material attached to the fan blades in accordance with an illustrative embodiment of the present invention.

In accordance with an illustrative embodiment of the present invention, the axial cooling fan shown in FIG. 1 comprises fan housing 12, rotatable shaft assembly 13 supported by the fan housing, and five fan blades 14 attached to the rotatable shaft assembly such that the fan blades rotate along with the shaft assembly. Specifically, each of fan blades 14, which may, for example, be manufactured from a sheet of metal or plastic, is advantageously disposed at an angle relative to their plane of movement so that air will be propelled in the appropriate direction when the fan blades rotate. (In the illustrative example of FIG. 1*a*, a clockwise rotation of shaft assembly 13 as shown would result in air being propelled "outward" from the page and toward the viewer of FIG. 1*a*.)

Moreover, fan blades 14 are advantageously provided with a curved surface which is concave as viewed from the perspective of FIG. 1*a*. In this manner, increased air movement is provided when shaft assembly 13 is rotated in a clockwise direction. As a result of the curvature, therefore, the illustrative cooling fan of FIG. 1*a* is specifically adapted to be rotated in a given (i.e., a preferred) direction—namely, clockwise as viewed from the perspective of FIG. 1*a*.

In other illustrative embodiments of the present invention, the fan blades are not curved, but are straight (although they are still most commonly disposed at an angle relative to their plane of movement). In these other embodiments, either direction of rotation for the shaft assembly may be alternatively chosen, depending on the direction that it is desired that air be propelled by the fan. In any case, however, given a particular direction of rotation (assuming that the fan blades are either merely angled or both curved and angled), the front side of the blade (i.e., the side which is moving into the otherwise stationary air between successive blades) will be the high pressure side of the fan blade, while the back side of the blade (i.e., the side which is moving away from the otherwise stationary air between successive blades) will be the low pressure side of the fan blade.

Figure 1B:
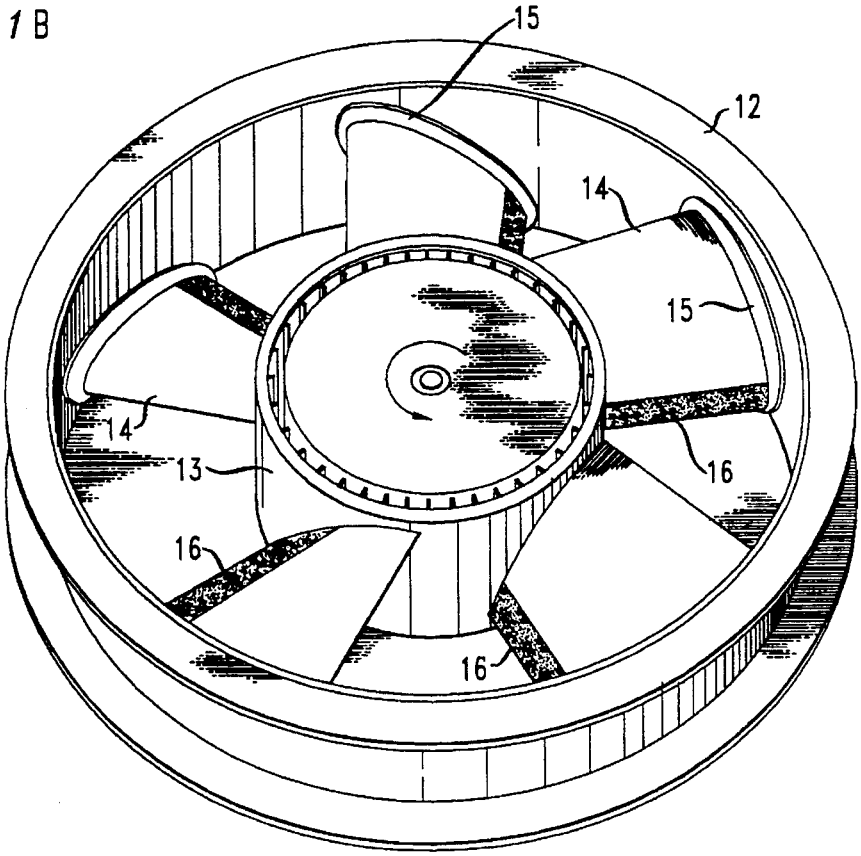

In accordance with the present invention, the illustrative cooling fan of FIG. 1 has strips of sound reducing material 16 attached alongside the trailing edges of the fan blades. Specifically, in the illustrative fan, shown in FIG. 1*a* this material is advantageously attached on the high pressure side of the fan blades, thereby ameliorating the effect of the above-described turbulence when it impacts with the following blade. (Note that the above-described turbulence, after it convects into a passage between successive blades, will impact the trailing edge of the blade following the one that generated it on the high pressure side thereof.) As shown in FIG. 1*b*, this embodiment also includes sound reducing material, attached on the low pressure side of the fan blades in order to address the effect of turbulence impacting the trailing edge of the same blade which generated it. (Note that this particular effect occurs on the low pressure side of the blade.) In other embodiments, sound reducing material may be placed on either the high pressure side or the low pressure side of the fan blades, but not both.

The sound reducing material may comprise any of a number of low-density materials which will absorb or dissipate aerodynamic energy, as opposed to higher-density materials which tend to pass or reflect such energy. Illustrative embodiments of the present invention include the use of sound reducing materials consisting of felt, loops from a hook-and-loop-type fastener such as that sold under the VELCRO trademark, or a small piece of fiberglass, cotton or wool batting. Alternatively, pieces of carpet or other low-density fabrics may be used. In any event, by placing such material alongside the trailing edge of the fan blade, the aerodynamic energy will be partially absorbed and/or dissipated, and, thereby, the aeroacoustic noise generated by the fan will be advantageously reduced.

The sound reducing material may be attached to the fan blades of the illustrative embodiment of FIG. 1 with use of a conventional adhesive. In particular, thin strips having a conventional pre-applied adhesive backing may be used. For example, VELCRO brand hook-and-loop-type fasteners comprise two different components—one containing hooks and one containing loops—each of which is typically provided on a strip with a pre-applied adhesive backing. The strip containing the loops, which has a soft, felt-like texture, may be used in accordance with an illustrative embodiment of the present invention by attaching these strips directly to the fan blades (alongside the trailing edge) with the pre-applied adhesive provided thereon.

The dimensions (the length, width and thickness) of the strips of sound absorbing material may vary in different embodiments, but the noise reducing effect (as well as the effect on the aerodynamic performance of the cooling fan) may vary in accordance therewith. Moreover, the effect of strips of various dimensions is related to the chord length (i.e., the distance from the leading edge to the trailing edge) of the fan blade. In the illustrative cooling fan shown in FIG. 1, for example, which illustratively has a chord length of approximately 2 inches, the strips of sound absorbing material advantageously extend the entire length of the trailing edges of the fan blades, each having a width of approximately three sixteenths (3/16) of an inch and a thickness of approximately one tenth (1/10) of an inch. In most cases, it will be found to be advantageous to extend the strip of sound absorbing material substantially the entire length of the trailing edges of the fan blades.

The illustrative cooling fan of FIG. 1 also has flanges 15 integrated with fan blades 14, located at the blade tip. These flanges advantageously act as barriers placed across the path of the above-described tip flow, thereby reducing the pressure differential across the above-described gap between the blade tip and the fan housing. In this manner, the air flow through the gap (i.e., the tip vortex flow) is reduced, thereby further reducing the aeroacoustic noise generated by the fan.

The flanges as illustratively shown in FIG. 1 are substantially planar elements, slightly curved so as to follow the inner wall of fan housing 12. The flanges are disposed at an angle which is substantially perpendicular to that of the fan blades. In addition, flanges 15 extend from the fan blades in both substantially perpendicular directions (i.e., both toward the front and toward the rear of the fan housing).

The distance that the flanges extend from the fan blades may vary in different embodiments, but the noise reducing effect (as well as the effect on the aerodynamic performance of the cooling fan) may vary in accordance therewith. Moreover, the effect of flanges of varying size is related to the blade tip speed of the rotating fan. The illustrative cooling fan shown in FIG. 1, for example, which illustratively rotates with a tip speed of approximately 540 inches per second, has flanges which advantageously extend a distance of approximately one fourth (1/4) of an inch (in each substantially perpendicular direction) from the surface of the fan blades.

In other illustrative embodiments of the present invention, the flanges may extend only either forward or backward from the fan blade, rather than extending in both directions therefrom. In addition, the flanges may be disposed at angles which are not substantially perpendicular to the fan blades, or may even be curved. Moreover, in accordance with various embodiments of the present invention, either the flanges may consist of a separately manufactured component which has been physically attached to a (separately manufactured) fan blade, or the fan blade and the flange may be parts of a single integrally manufactured element.

Although a number of specific embodiments of this invention have been shown and described herein, it is to be understood that these embodiments are merely illustrative of the many possible specific arrangements which can be devised in application of the principles of the invention. Numerous and varied other arrangements can be devised in accordance with these principles by those of ordinary skill in the art without departing from the spirit and scope of the invention.

For example, although the illustrative embodiment of the present invention described herein has been directed in particular to axial cooling fans, it will be appreciated by those skilled in the art that the principles of the present invention may be applied to a wide variety of devices generically known to those in the art as "air moving devices." As used herein, the term "air moving devices" is intended to encompass any device used to produce or enhance air movement for any purpose whatsoever, including, but not limited to, cooling fans such as axial cooling fans and centrifugal blowers.

In addition, although the illustrative embodiment of the present invention described herein shows flange elements integrated with fan blades wherein the flanges are substantially planar elements, the use of the term "flange" is not intended to be so limited. Rather, the term "flange" as used herein is intended to encompass any "protruding rim, edge, rib or collar" which extends or protrudes from the surface of the fan blade, regardless of its shape, and regardless of its intended purpose. (See, e.g., The American Heritage Dictionary, Second College Edition, 1991, defining "flange" as "a protruding rim, edge, rib or collar, as on a wheel or a pipe shaft, used to strengthen an object, hold it in place, or attach it to another object.") As will be obvious to those skilled in the art given the teachings of the disclosure herein, any "protruding rim, edge, rib or collar" attached to or integrated with the fan blades of an air moving device may advantageously result in a reduction of the tip vortex flow (and thereby a reduction in aeroacoustic noise).

Also, the terms "sound reducing material" and "aerodynamic energy absorbing material" as used herein are each intended to encompass any material having a relatively low density—that is, any material having a density lower than that of the material of the fan blade with which it is integrated (e.g., attached). In this manner, at least a portion of a quantity of the turbulent aerodynamic energy will be absorbed upon impact with the fan blade, thereby resulting in a reduction of the aeroacoustic noise generated by the fan. As will be obvious to those skilled in the art, many such materials other than felt, loops from a hook-and-loop-type fastener, batting, carpet, etc., as illustratively described above, may be used in accordance with other illustrative embodiments of the present invention.

I claim:

1. An air moving device comprising a rotatable shaft assembly and a plurality of fan blades coupled to said rotatable shaft assembly, each of said fan blades having a trailing edge when the rotatable shaft assembly is rotated in a given direction, wherein at least one of the fan blades has a sound reducing material attached to a surface thereof alongside the trailing edge thereof, wherein said sound reducing material comprises an aerodynamic energy absorbing material, and wherein said aerodynamic energy absorbing material comprises felt.

2. The air moving device of claim 1 wherein each of the fan blades has a low pressure side and a high pressure side when the fan is rotated in the given direction, and wherein said sound reducing material is attached alongside the trailing edge of said fan blade on the high pressure side thereof.

3. The air moving device of claim 1 wherein each of the fan blades has a low pressure side and a high pressure side when the fan is rotated in the given direction, and wherein said sound reducing material is attached alongside the trailing edge of said fan blade on the low pressure side thereof.

4. The air moving device of claim 1 wherein each of the fan blades has a low pressure side and a high pressure side when the fan is rotated in the given direction, and wherein said sound reducing material is attached alongside the trailing edge of said fan blade on both the high pressure side and the low pressure side thereof.

5. An air moving device comprising a rotatable shaft assembly and a plurality of fan blades coupled to said rotatable shaft assembly, each of said fan blades having a trailing edge when the rotatable shaft assembly is rotated in a given direction, wherein at least one of the fan blades has a sound reducing material attached to a surface thereof alongside the trailing edge thereof, wherein said sound reducing material comprises an aerodynamic energy absorbing material, and wherein said aerodynamic energy absorbing material comprises loops from a hook-and-loop-type fastener.

6. The air moving device of claim 5 wherein each of the fan blades has a low pressure side and a high pressure side when the fan is rotated in the given direction, and wherein said sound reducing material is attached alongside the trailing edge of said fan blade on the high pressure side thereof.

7. The air moving device of claim 5 wherein each of the fan blades has a low pressure side and a high pressure side when the fan is rotated in the given direction, and wherein said sound reducing material is attached alongside the trailing edge of said fan blade on the low pressure side thereof.

8. The air moving device of claim 5 wherein each of the fan blades has a low pressure side and a high pressure side when the fan is rotated in the given direction, and wherein said sound reducing material is attached alongside the trailing edge of said fan blade on both the high pressure side and the low pressure side thereof.

9. A method of reducing noise generated by an air moving device, the air moving device comprising a rotatable shaft assembly and a plurality of fan blades coupled to said rotatable shaft assembly, each of said fan blades having a trailing edge when the rotatable shaft assembly is rotated in a given direction, the method comprising the step of attaching a sound reducing material to the surface of at least one of said fan blades alongside the trailing edge thereof, wherein said sound reducing material comprises an aerodynamic energy absorbing material, wherein said aerodynamic energy absorbing material comprises felt.

10. The method of claim 9 wherein each of the fan blades has a low pressure side and a high pressure side when the fan is rotated in the given direction, and wherein said sound reducing material is attached to the trailing edge of said fan blade on the high pressure side thereof.

11. The method of claim 9 wherein each of the fan blades has a low pressure side and a high pressure side when the fan is rotated in the given direction, and wherein said sound reducing material is attached to the trailing edge of said fan blade on the low pressure side thereof.

12. The method of claim 9 wherein each of the fan blades has a low pressure side and a high pressure side when the fan is rotated in the given direction, and wherein said sound reducing material is attached to the trailing edge of said fan blade on both the high pressure side and the low pressure side thereof.

13. A method of reducing noise generated by an air moving device, the air moving device comprising a rotatable shaft assembly and a plurality of fan blades coupled to said rotatable shaft assembly, each of said fan blades having a trailing edge when the rotatable shaft assembly is rotated in a given direction, the method comprising the step of attaching a sound reducing material to the surface of at least one of said fan blades alongside the trailing edge thereof, wherein said sound reducing material comprises an aerodynamic energy absorbing material, wherein said aerodynamic energy absorbing material comprises loops from a hook-and-loop-type fastener.

14. The method of claim 13 wherein each of the fan blades has a low pressure side and a high pressure side when the fan is rotated in the given direction, and wherein said sound reducing material is attached to the trailing edge of said fan blade on the high pressure side thereof.

15. The method of claim 13 wherein each of the fan blades has a low pressure side and a high pressure side when the fan is rotated in the given direction, and wherein said sound reducing material is attached to the trailing edge of said fan blade on the low pressure side thereof.

16. The method of claim 13 wherein each of the fan blades has a low pressure side and a high pressure side when the fan is rotated in the given direction, and wherein said sound reducing material is attached to the trailing edge of said fan blade on both the high pressure side and the low pressure side thereof.

17. An air moving device comprising a rotatable shaft assembly and plurality of fan blades coupled to said rotatable shaft assembly, each of said fan blades composed of a first material having a density, each of said fan blades having a trailing edge when the rotatable shaft assembly is rotated in a given direction, wherein at least one of the fan blades has a second material attached thereto alongside the trailing edge thereof, said second material having a density which is less than the density of the first material, wherein said second material comprises felt.

18. The air moving device of claim 17 wherein each of the fan blades has a low pressure side and a high pressure side when the fan is rotated in the given direction, and wherein said second material is attached to the trailing edge of said fan blade on the high pressure side thereof.

19. The air moving device of claim 17 wherein each of the fan blades has a low pressure side and a high pressure side when the fan is rotated in the given direction, and wherein said second material is attached to the trailing edge of said fan blade on the low pressure side thereof.

20. The air moving device of claim 17 wherein each of the fan blades has a low pressure side and a high pressure side when the fan is rotated in the given direction, and wherein said second material is attached to the trailing edge of said fan blade on both the high pressure side and the low pressure side thereof.

21. An air moving device comprising a rotatable shaft assembly and a plurality of fan blades coupled to said rotatable shaft assembly, each of said fan blades composed of a first material having a density, each of said fan blades having a trailing edge when the rotatable shaft assembly is rotated in a given direction, wherein at least one of the fan blades has a second material attached thereto alongside the trailing edge thereof, said second material having a density which is less than the density of the first material, wherein said second material comprises loops from a hook-and-loop-type fastener.

22. The air moving device of claim 21 wherein each of the fan blades has a low pressure side and a high pressure side when the fan is rotated in the given direction, and wherein said second material is attached to the trailing edge of said fan blade on the high pressure side thereof.

23. The air moving device of claim 21 wherein each of the fan blades has a low pressure side and a high pressure side when the fan is rotated in the given direction, and wherein said second material is attached to the trailing edge of said fan blade on the low pressure side thereof.

24. The air moving device of claim 21 wherein each of the fan blades has a low pressure side and a high pressure side when the fan is rotated in the given direction, and wherein said second material is attached to the trailing edge of said fan blade on both the high pressure side and the low pressure side thereof.

* * * * *